US006974922B2

(12) United States Patent
Bortolloni et al.

(10) Patent No.: US 6,974,922 B2
(45) Date of Patent: Dec. 13, 2005

(54) ROTARY SERVICE SWITCH FOR THE INTERIOR OF ELECTRICAL ENCLOSURES HAVING A DISCONNECT SWITCH

(75) Inventors: Sergio Bortolloni, Sesto San Giovanni (IT); Giuseppe Zanaglio, Paderno Dugnano (IT); Miriam Biagini, Saronno (IT); Massimo Baldo, Paderno Dugnano (IT); Karen Hecht, Shorewood, WI (US); Theodore J. Houck, III, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/813,103

(22) Filed: Mar. 30, 2004

(65) Prior Publication Data

US 2005/0224324 A1 Oct. 13, 2005

(51) Int. Cl.[7] ..... H01R 19/00
(52) U.S. Cl. ..... 200/50.06; 200/50.05
(58) Field of Search ..... 200/43.04, 331, 200/43.08, 330, 43.11, 564, 43.14, 566, 43.15, 200/568, 50.05, 336, 50.06, 50.11

(56) References Cited

U.S. PATENT DOCUMENTS 3,739,109 A * 6/1973 Ege ..... 200/4
3,970,808 A * 7/1976 Gryctko et al. ..... 200/50.15
4,851,621 A * 7/1989 Borchardt et al. ..... 200/50.05
6,100,485 A * 8/2000 Mortun et al. ..... 200/572
6,700,081 B1 3/2004 Houck, III
6,797,896 B2 * 9/2004 Lee ..... 200/6 A
6,797,903 B1 * 9/2004 Winslett et al. ..... 200/331
2004/0099515 A1 5/2004 Houck, III

OTHER PUBLICATIONS

Rockwell Automation Bulletins 194C, 194E, 194L, "Flexible Solutions in Control and Load Switches", pp. 2, 3, 4, 34, 36, 43, 46, 47, 48, and 49, Jan. 1999.

* cited by examiner

*Primary Examiner*—Elvin G Enad
*Assistant Examiner*—Lisa Klaus
(74) *Attorney, Agent, or Firm*—Quarles & Brady LLP; Alexander M. Gerasimow

(57) ABSTRACT

A rotary switch assembly for mounting on a disconnect switch (10) in an electrical enclosure (26) includes a base (50) and a rotor (60) which is rotatably coupled to the base (50). The rotor (60) is first axially depressed and then rotated to switch the disconnect switch (10) to the "on" position. The base (50) has a stop member (53) for latching the rotor (60) in an "off" position before the rotor (60) is axially depressed. A lockout tab (43) is attached to the rotor (60) for locking the switch in the "off" position. A rotary handle (30, 90) is provided for mounting on the rotor (60), for operation in either rotational direction. The rotary handle (30) has two wings with formed grips (34, 35) for thumb and fingertips to securely grip and turn the handle (30) with the required torque for actuating and de-actuating the disconnect switch.

16 Claims, 5 Drawing Sheets

ROTARY SERVICE SWITCH FOR THE INTERIOR OF ELECTRICAL ENCLOSURES HAVING A DISCONNECT SWITCH

CROSS-REFERENCE TO RELATED APPLICATIONS

NOT APPLICABLE

STATEMENT REGARDING FEDERALLY SPONSORED RESEARCH

NOT APPLICABLE

TECHNICAL FIELD

The field of the invention is fused and non-fused disconnect switches of the type used in enclosures for electrical control equipment.

BACKGROUND ART

In factory automation and other commercial applications requiring control of motors and other electrical equipment, it is typical to mount electrical controls in a cabinet-styled enclosure. A door handle interlock mechanism is provided, so that when the door handle is operated to open the cabinet door and access the electrical control equipment, power is turned off. In particular, power to the other devices in the cabinet is supplied through a fused or non-fused disconnect switch. This switch may have multiple circuits or poles to handle polyphase voltages which may be supplied to the electrical equipment.

A switch handle for this use must be capable of transmitting sufficient torque to open and close the disconnect switch with the snap action typical in such switches.

Once the cabinet has been opened, it may be desirable for service operations to again apply power to the devices in the cabinet. In the past, this was accomplished through certain types of methods for overriding the door interlock switch.

New standards have required that an on-off switch be provided in the interior of the cabinet for maintaining a locked-out "off" condition of the disconnect switch when the door of the enclosure is open. The standards also require that the switch be operable by qualified persons, independent of door position, and that in order to be switched to an "on" condition with the door open, the switch should require a deliberate action of the qualified person. The switch should also be capable of compatibility with various door interlock mechanisms available now and in the future.

SUMMARY OF THE INVENTION

The invention relates to a rotary switch for switching a fused or non-fused disconnect switch between an "on" position and an "off" position. The switch requires that a person apply a first force axially inward and then a second force in a rotational direction, for example, a quarter turn, to move the switch to the "on" position. This two-step operation requires a deliberate action and avoids inadvertent switch actuations.

The switch of the present invention is provided with a handle that is particularly advantageous for rotation in either direction. The handle provides a first grip for a thumb and opposing fingers for turning the handle in one direction and a second grip for a thumb and opposing fingers for turning the handle in an opposite direction.

The switching mechanism for the switch of the present invention includes a rotor and a base. The base has a central cylindrical cavity and a stop projecting inwardly from an interior wall of the cavity that limits rotation of the rotor according to the axial position of the rotor.

The rotor uses a "split-shaft" mechanism in which the switch rotor has an axial socket opening to receive an upper end of a shaft for actuating the disconnect switch. When the switch rotor is pressed inward to its operating position, the socket opening slips over an end of the shaft and as a result of non-circular cross section will transmit a torque to the shaft to actuate and de-actuate the disconnect switch.

The rotor has an arcuate groove in an outer surface that extends around an angular distance slightly less than 180 degrees. The groove allows rotation of the switch rotor to switch positions for "on" "off" and "test," when the rotor is in the inserted to a depth corresponding to the operable position. Along the axial depth of the groove is a notch, which when the rotor is withdrawn to its fullest extent and when the switch is in the "off" position is latched by the stop to prevent movement in either rotational direction. In addition, the rotor is provided with a holed lockout tab which aligns with a holed lockout tab on the switch base to receive a locking member to lockout the switch when in the "off" position.

The rotary handle can be mounted on the switch rotor, and a shaft of preferably non-circular cross section can be provided to extend through the handle to the door handle to interlock therewith.

It is one object of the invention to provide a switch that meets current standards set forth by standards organizations for this type of equipment.

It is another object of the invention to provide a rotary switch that is compact and easy to install on a disconnect switch assembly inside the electrical enclosure in retrofit applications.

It is another object of the invention to provide a switch for applying the torque necessary to operate disconnect switches in equipment cabinets.

It is another object of the invention to be compatible with existing interlock systems using an extendible shaft.

These and other objects and advantages of the invention will be apparent from the description that follows and from the drawings which illustrate embodiments of the invention, and which are incorporated herein by reference.

DETAILED DESCRIPTION

Figure 1:
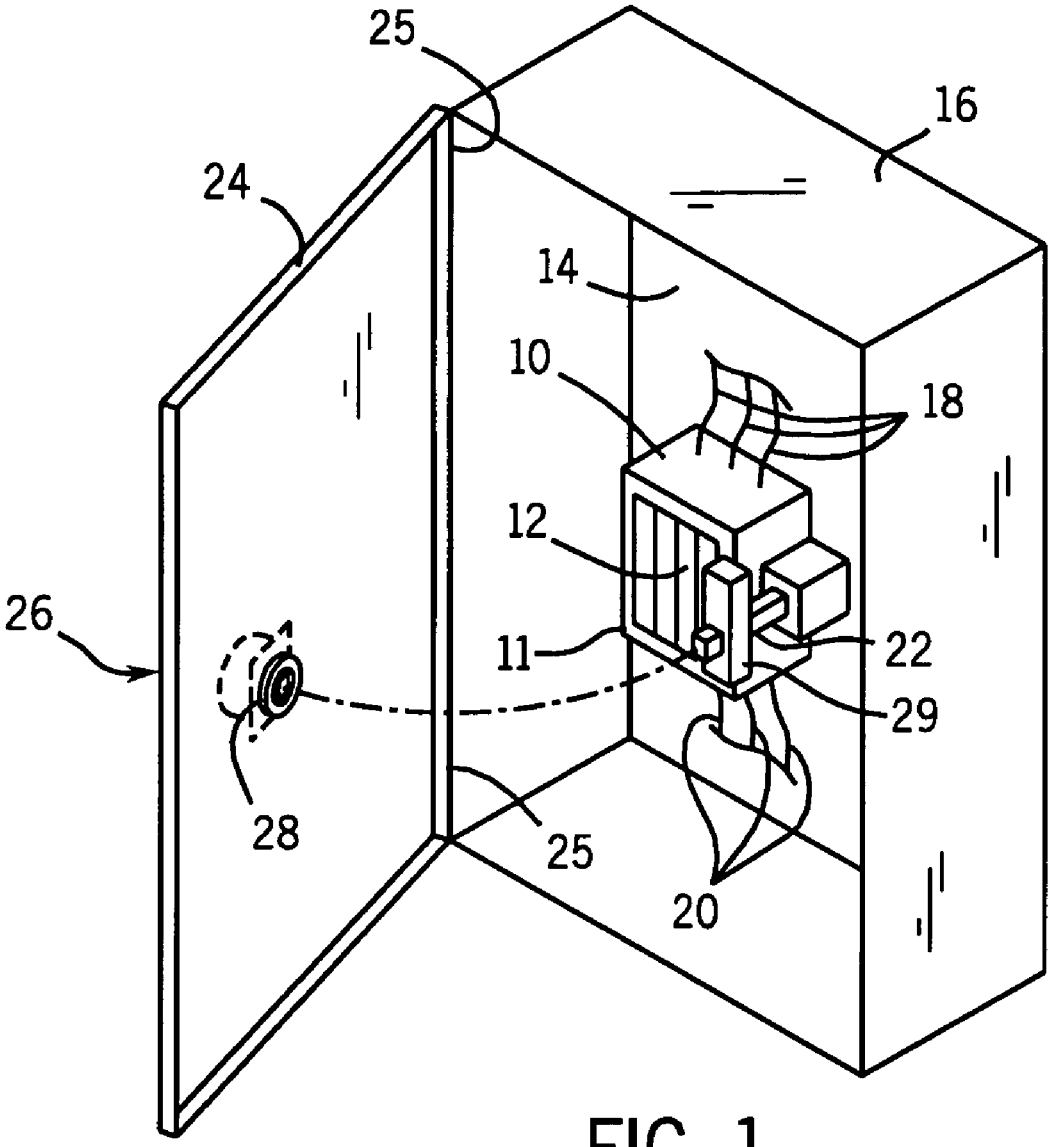
FIG. 1 is a perspective view of a disconnect switch assembly installed in an electrical enclosure with an interior switch of the present invention.

FIG. 1 illustrates a disconnect switch 10 which is mounted in the interior of an enclosure 26 with other electrical control equipment (not shown), such as relays, contactors and motor starters, to control the connection of electrical power to items inside the enclosure 26. The cabinet enclosure 26 includes a door 24 mounted by top and bottom hinges 25 to the cabinet body 16, for opening and closing a frontal access opening into a cabinet body 16. The disconnect switch 10 receives switch contact cartridges 12, which can include fuses and which be inserted in a supporting frame 11 for the disconnect switch. The electrical power is typically three-phase power and the disconnect switch 10 has at least three fuse cartridges 12*a*, 12*b*, 12*c* (FIG. 2) corresponding to switch poles or sub-circuits and is rated for three-phase operation, although single-phase operation is also possible.

Electrical power is received through one set of input lines 18 in FIG. 1 connecting to input terminals along the top of the disconnect switch 10. From there, power is routed to the fuse cartridges 12. Output lines 20 are connected to output terminals along the bottom of the disconnect switch 10, to conduct power to the other equipment in the cabinet.

A handle 28 on the front of the door 24 in FIG. 1 is coupled (interlocked) through a shaft 22 to operate the actuating mechanism of the switch 10. The disconnect switch 10 and its contacts are closed or "on", when the door 24 of the enclosure 10 is closed and the handle 28 is in the closed and locked position. When the door handle 28 is moved to a fully "open" position, to open the door 24 of the enclosure, the actuating mechanism in the switch 10 will have been moved to open the contacts, so that power to the cabinet is disconnected. This is a simplified explanation of the operation of the door handle 28, for the purpose of the present invention. A more complex opening sequence may be employed, but it forms no part of the present invention.

The disconnect switch 10 of the present invention is provided in sizes with ratings of 60 amps, 30 amps and smaller. A switch actuating mechanism for this use must be capable of transmitting sufficient torque to open and close the disconnect switch with the snap action typical in such switches. The torque required to actuate and de-actuate a 30-amp disconnect switch is 20 inch-lbs., while the torque required to actuate and de-actuate a 60-amp disconnect switch is 40 inch-lbs.

Once the cabinet 26 has been opened, it may be desirable for service operations to again apply power to the devices in the cabinet 26. In the past, this was accomplished through certain types of methods for overriding the door interlock handle 28 and interlock shaft 22.

New standards have required that an on-off switch handle be provided in the interior of the cabinet for maintaining a locked-out "off" condition of the disconnect switch 10 when the door 24 of the enclosure 26 is open. The standards also require that the switch handle assembly be operable by qualified persons, independent of door position, and that in order for the disconnect switch 10 to be switched to an "on" condition with the door 24 open, the switch handle assembly should require a deliberate action of the qualified person. The switch handle assembly should also be capable of compatibility with various door interlock mechanisms available now and in the future.

Referring to FIG. 1, a rotary switch assembly 29 is installed inside an electrical enclosure 26 on a disconnect switch 10 to control actuation and de-actuation of the disconnect switch contacts through a two-part movement, first, in an axial direction, and then, in a rotational direction.

Figure 2:
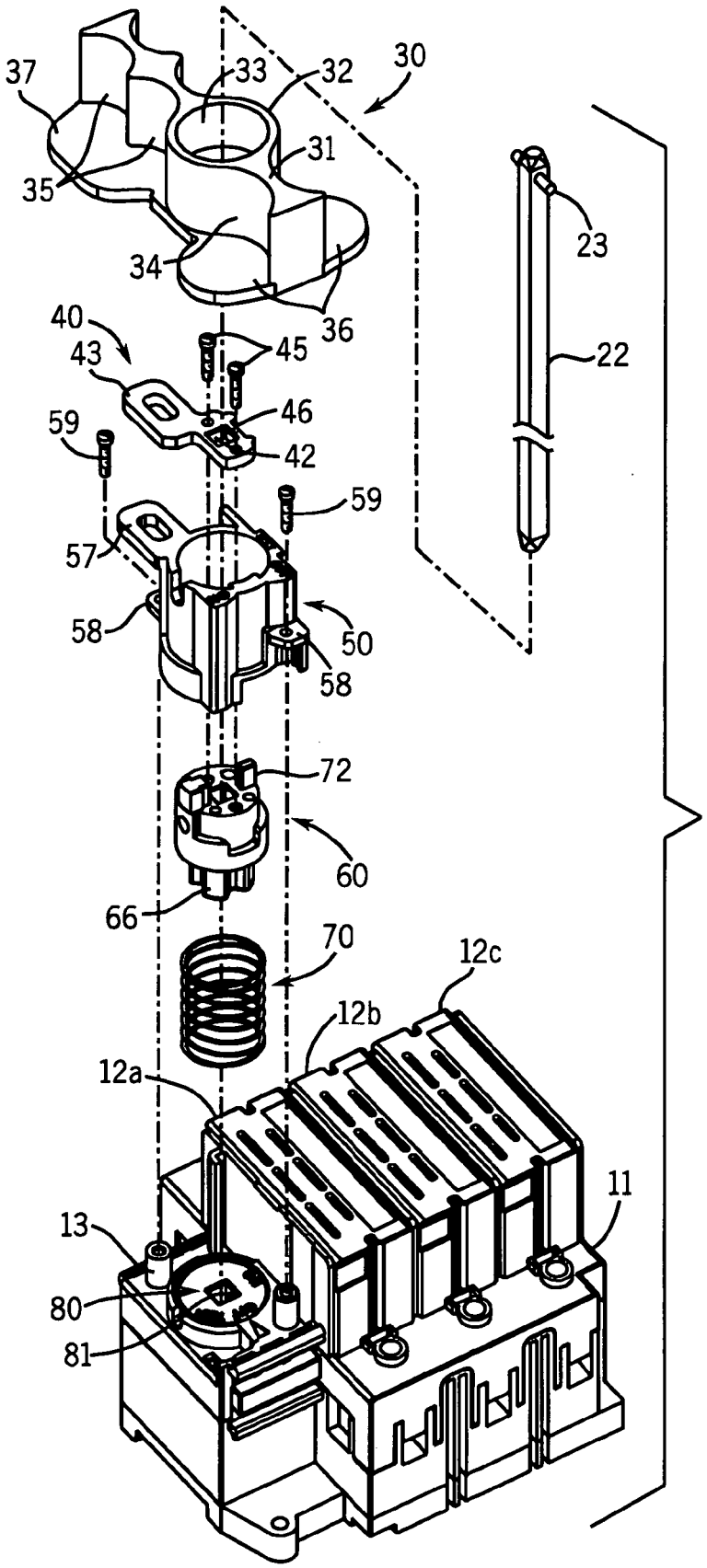
FIG. 2 is an exploded, perspective view of the interior switch assembly of the present invention seen in FIG. 1.

As seen in FIG. 2, the assembly 29 includes a rotary handle 30, which is formed symmetrically along a central rib 31 having two wings extending from an annular hub 32. A first grip is formed by a first groove 34 for a thumb along a first side of the rib 31 and grooves for two opposing fingers (like grooves 35) along an opposite side of central rib 31 for turning the handle 30 in one direction. The second grip is formed by a groove for a thumb on the opposite side from first groove 34, and by grooves 35 for two opposing fingers on the first side of the central rib 31 for turning the handle 30 in an opposite rotational direction. Rests 36, 37 are formed to extend laterally from the bottom of the rib 31 to support the thumb an forefingers placed in grooves 34, 35. The rotary handle 30 therefore forms a first grip for gripping and rotating the handle 30 in one rotational direction and a second grip formed for gripping and turning the handle 30 in an opposite rotational direction.

Figure 3:
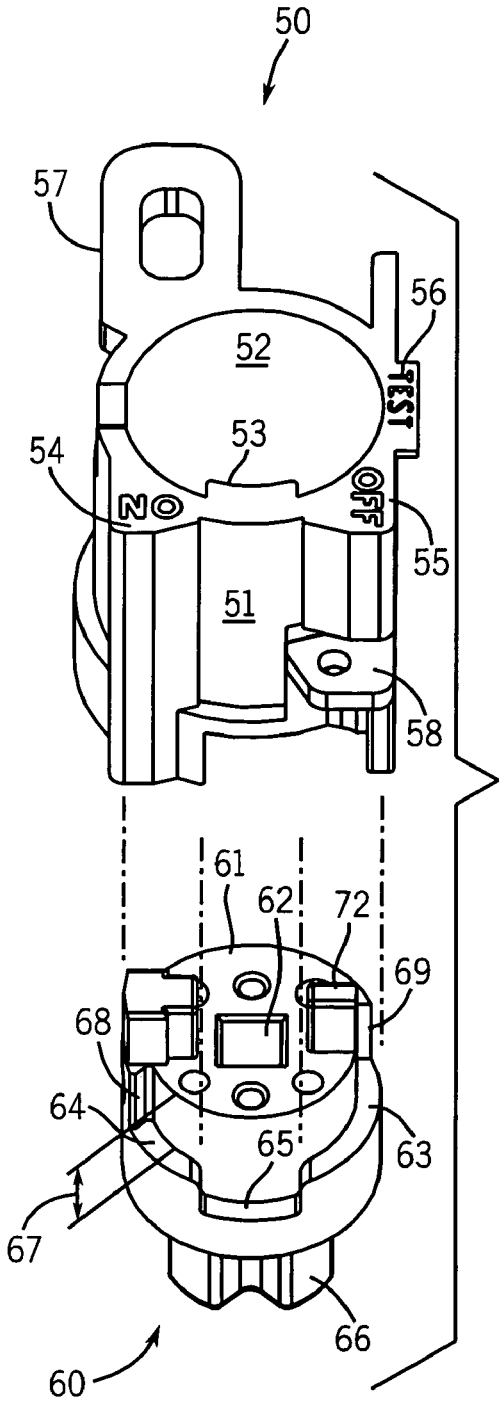
FIG. 3 is a detail perspective view of a rotary switch mechanism included in the switch assembly of FIG. 2.
Figure 6:
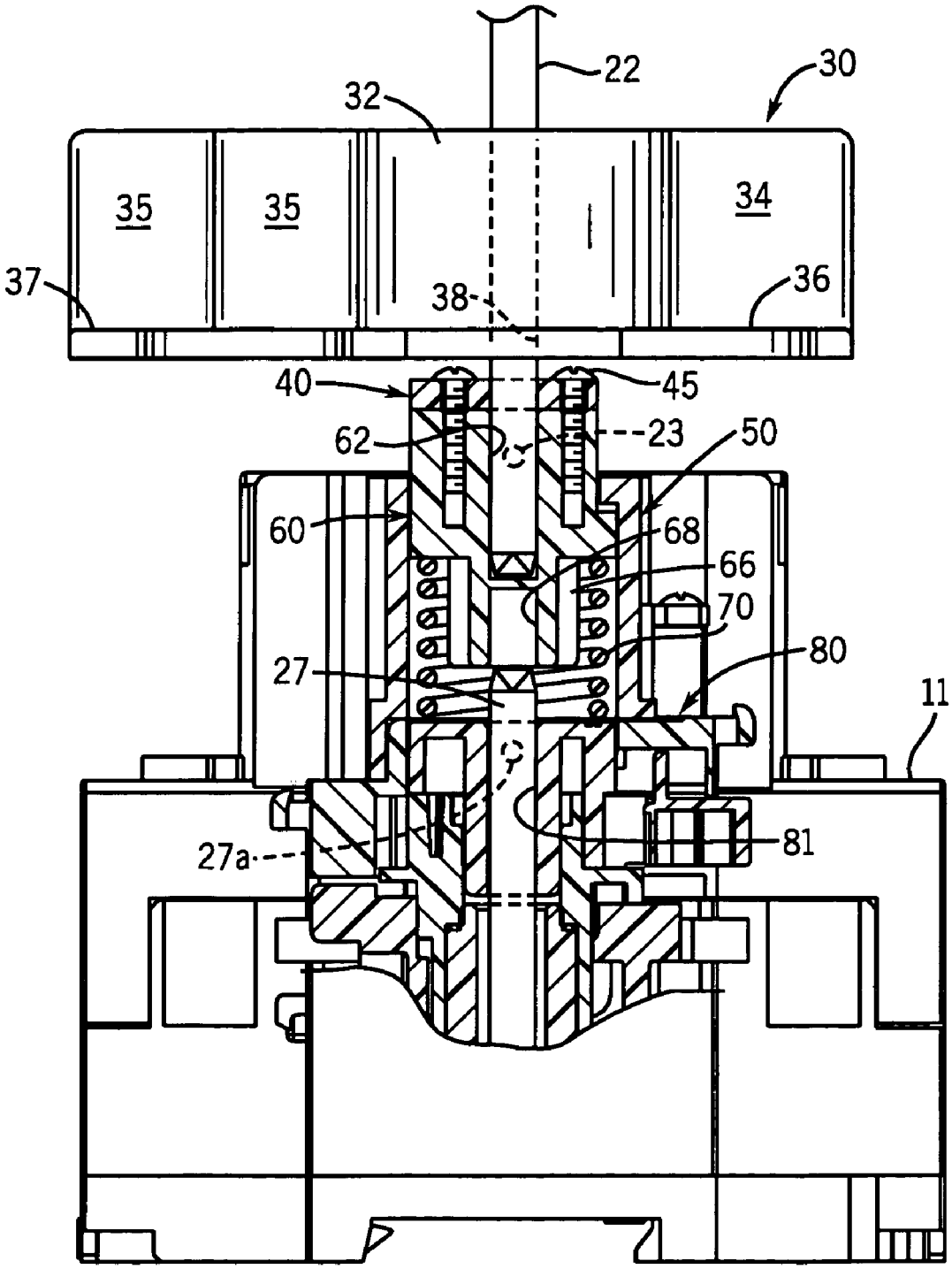
FIG. 6 a sectional view through the rotary switch assembly of FIG. 2, when assembled to the disconnect switch seen in FIG. 1, taken in the plane indicated by line 6—6 in FIG. 4.

The handle 30 is installed on extension shaft 22, the handle 30 having a square aperture 38 (hidden in FIG. 2, but represented in FIG. 6) for receiving the shaft 22. The extension shaft 22 has a non-circular cross section and fits through this aperture 38, so as to allow application of torque without the handle 30 slipping on the shaft 22. The extension shaft 22 then extends to the door handle 28, as seen in FIG. 1, which fits over one end of the shaft 22 when the cabinet door 24 is closed. The lower end of the shaft 22 is received in an upwardly opening aperture 62 in the rotor 60 (FIGS. 3 and 6). The rotor 60 couples the extension shaft 22 to another shaft 27 of non-circular cross section (FIG. 6). The rotor 60 has a stem 66 with an aperture 62 (FIG. 6) that receives an upper end of the shaft 27, when the rotor is moved axially inward by a first force, for actuating the disconnect switch 10. The lower end of this shaft 27 is received in an aperture 81 in a main actuating mechanism 80 (FIGS. 2, 6) for the disconnect switch 10. In FIG. 6, in the "off" position, the stem is de-coupled from the upper end of the shaft 27. This is called a "split-shaft" arrangement, which allows coupling and de-coupling to the actuating mechanism. Each of the shafts 22, 27 is secured by a respective cross pin 23, 27*a* in the component (28, 80) receiving it.

The disconnect switch actuating mechanism 80 has three positions, "on", "off" and "test", as shown in FIG. 2. In the "off" position, the switch contacts in the disconnect switch are open and power is disconnected from equipment in the cabinet 26. When the mechanism 80 is rotated ninety degrees clockwise to the "on" position, the rotational action is translated to a rotational member (not shown) extending transversely to the switch cartridges 12 and when this member is moved, the switch contacts are closed with a snap action. This mechanism 80 is known from prior disconnect switches and is not part of the present invention.

The switch assembly of the present invention is mounted over an upper end of the shaft 27 seen in FIG. 6. This allows the disconnect switch actuating mechanism to be operated from inside the cabinet 26 as seen in FIGS. 1 and 2. It also provides a mechanism that requires that a person apply a first force axially inward and then a second force in a rotational direction, preferably at least a quarter turn, to move the switch to the "on" position. This two-step operation requires a deliberate action and avoids inadvertent switch actuations.

Referring now to FIG. 2, the switch assembly 29 also includes a switching mechanism provided by a base 50 and a rotor 60. The rotor 60 has a stem 66 which acts as a spring supporting member (FIGS. 2 and 3) extending towards a bottom end and separated from an interior wall of the base 50 by an annular space (FIG. 6). A coiled compression spring 70 (FIGS. 2 and 6) is captured in the annular space formed between the rotor 60 and the base 50 as seen in FIG. 6 and has a lower end that seats against mechanism 80 and an upper end that is pressed on by the rotor 60. The rotor 60 may slide axially inward within the base 50, providing a force is applied to compress the spring 70. When the axial force is released and assuming that notch 65 is aligned with stop 53 (FIG. 4), the spring provides a force to return the rotor to its "off" position seen in FIG. 4.

Figure 4:
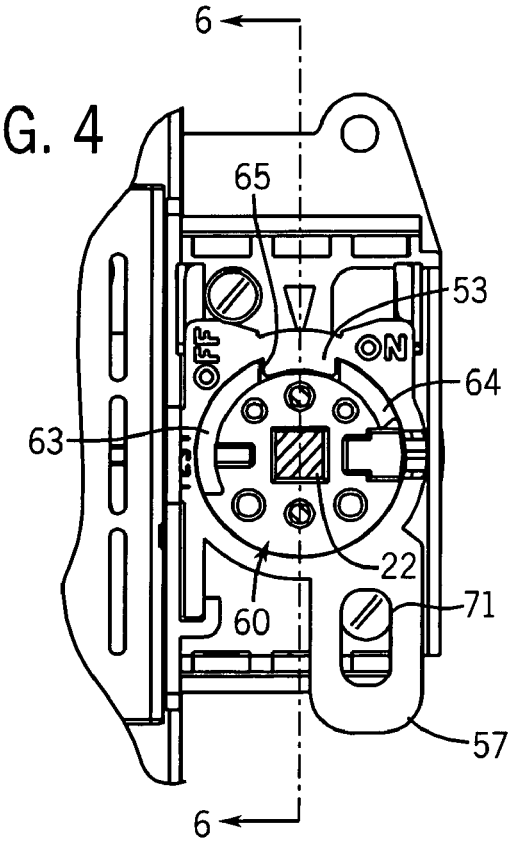
FIG. 4 is a top plan view of the rotary switch mechanism of FIGS. 2 and 3 with the rotor in the "off" and locked out position.

A lockout member 40 in FIG. 2 is fastened to the rotor 50 with screws 45 which are received in threaded holes in the top of the rotor 60. The lockout member 40 has a square aperture 42 allowing the extension shaft 22 to pass through. The lockout member 40 also forms a holed tab 43 for receiving the shackle on a padlock, a cable tie or other locking member permitted by applicable standards. This holed tab 43 becomes aligned with a corresponding holed tab 57 on the base 50, when the rotor 60 and lockout member 40 are assembled to the base 50 with rotor 60 in the "off" position (FIG. 4). The lockout member 40 has a notch 46 (FIG. 2) for receiving square post 72 on the rotor 60 to anchor the lockout member 40 and rotor 60 against rotation.

The rotor 60, seen in FIG. 3, is inserted into a central cavity 52 in a body 51 of the base 50 from the bottom, as illustrated in FIG. 2. The base 50 is then mounted to bosses 13 on the switch body 11 using screws 59 which are inserted through holed flanges 58.

Figure 5:
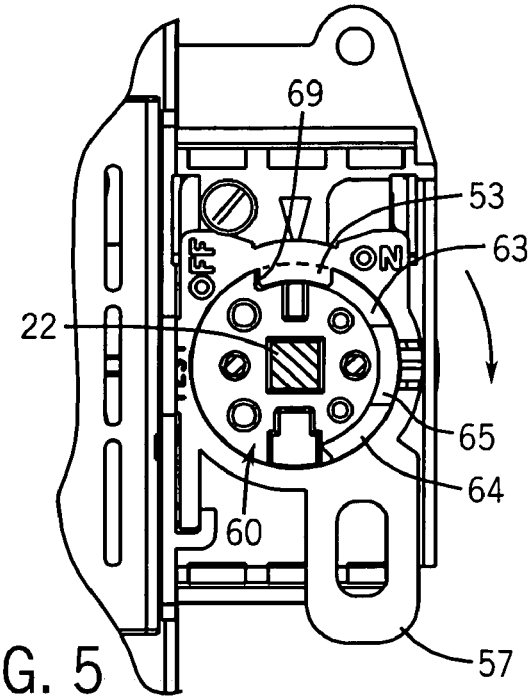
FIG. 5 is a top plan view of the rotary switch mechanism of FIGS. 2 and 3 in an "on" position.

The rotor 60 rotates ninety degrees clockwise (represented by arrow in FIG. 5) between an "off" position shown in FIG. 4, and an "on" position shown in FIG. 5. Inscribed legends 54, 55 and 56 are provided on the base 50 to indicate the relative positions, but not exact positions, for the three switch positions "on", "off" and "test". Labels could also be used. The rotor 60 has an arcuate groove in an outer surface that extends around an angular distance between stop surfaces 68 and 69 (FIG. 3), which are less than 180 degrees apart. This arcuate groove also forms surfaces 63 and 64 at a first depth and notch 65 at a second axial depth seen best in FIG. 3. When the rotor 50 is axially withdrawn by more than distance 67 seen in FIG. 3, with the notch 65 aligned with stop 53, the notch 65 will be pulled into engagement with stop 53, and this is the withdrawn or "off" position (FIG. 4), in which the rotor 60 cannot be rotated in either direction. When the rotor 60 is moved axially inward into the base 50 in response to an axial force, the notch 65 will pass below stop 53 and the surfaces 63 or 64 will slide under it depending on the direction of rotation. Surfaces 63 and 69 allow the rotor to be moved one quarter turn clockwise to the "on" position (FIG. 5). Surfaces 64 and 67 allow the rotor 60 to be moved less then a quarter turn counterclockwise to the "test" position (not illustrated).

Figure 7:
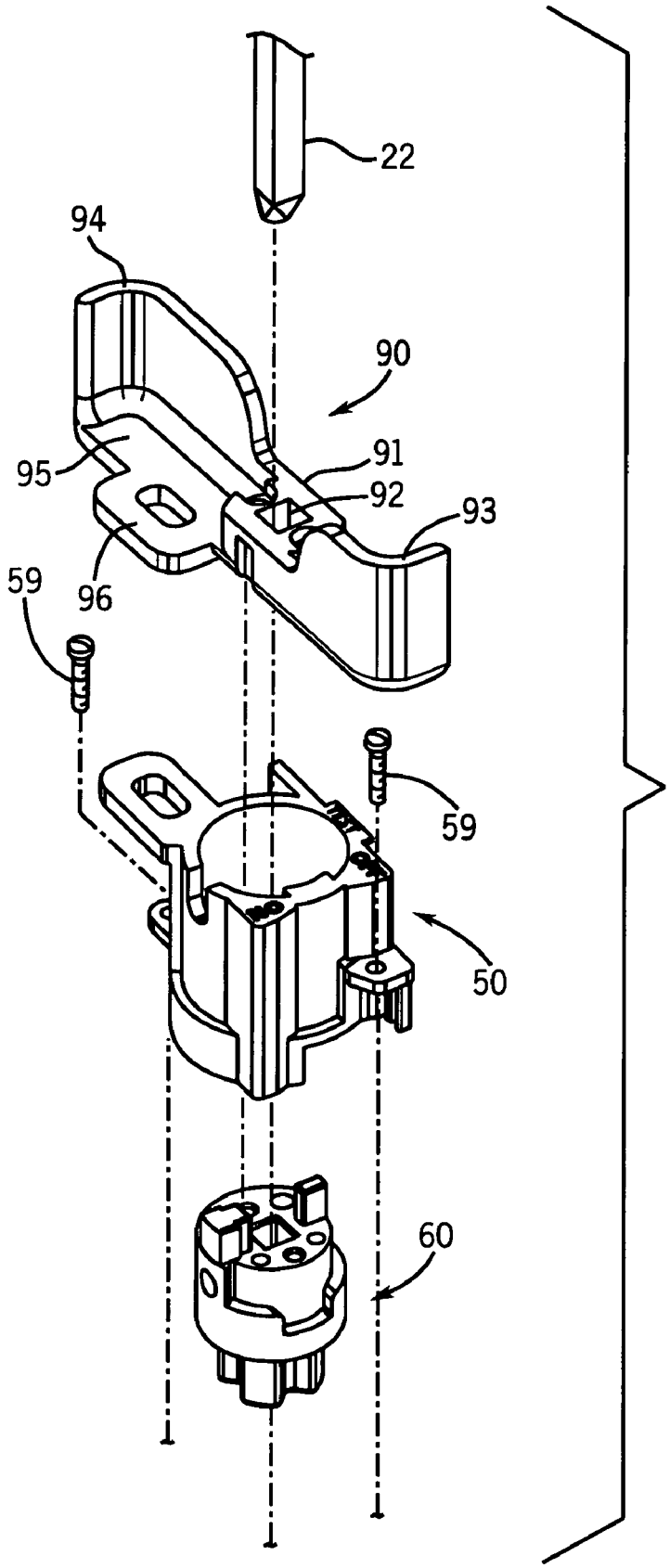
FIG. 7 is an exploded, perspective view of a rotary switch assembly of the present invention with a modified rotary switch handle.

FIG. 7 shows a view of a rotary switch assembly of the present invention with a modification to the rotary switch handle 90. This handle 90 has a central portion 91 with an aperture 92 of square cross section like handle 30 to receive shaft 22. However, extending from opposite sides of central portion 91 along a longitudinal axis are two upright wings 93 and 94 with curved ends facing in opposite directions to receive a thumb and forefingers of one hand. The wings 93, 94 function when the handle 90 is being rotated in either direction, with the thumb and forefingers being reversed relative to the two respective wings 93, 94 to rotate the handle in the opposite direction. A holed tab 96 is integrated with a finger rest 95 below wing 94. This tab 96 is aligned with tab 57 on the rotor 50, when the rotor 50 is in the "off" position, which allows a shackle 71 of a lock to be placed through the tabs 57, 96 (see FIG. 4) to lock them together and prevent operation of the switch assembly 90, 50. From this is apparent to one of ordinary skill in the art that a holed lockout tab could also be integrated with handle 30.

It can be seen from the above description that the invention provides a rotary switch that is compact and easy to install on a disconnect switch assembly inside the electrical enclosure in retrofit applications. The invention also provides a switch capable of applying the torque necessary to operate disconnect switches in equipment cabinets. It can also be seen that the switch assembly is compatible with existing interlock systems using an extendible shaft. The invention also provides a positive lockout feature.

This has been a description of several preferred embodiments of the invention. It will be apparent that various modifications and details can be varied without departing from the scope and spirit of the invention, and these are intended to come within the scope of the following claims.

We claim:

1. A rotary switch for installation on a disconnect switch to actuate and de-actuate the disconnect switch contacts, the rotary switch comprising:

a base;

a rotor disposed for rotation on said base and responsive to a first force in an axial direction for coupling to a disconnect switch actuating mechanism, and responsive to a second force in a rotational direction to actuate the disconnect switch; and a stop member on said base for latching the rotor in an "off" position before application of said first force to prevent a rotation of the rotor that would actuate the disconnect switch.

2. The rotary switch of claim 1, wherein the rotor has a socket opening on an inwardly directed end that opens axially inward to receive an upper end of a shaft for actuating the disconnect switch, the socket opening fitting over an end of the shaft when the rotor is moved axially inward by the first force.

3. The rotary switch of claim 1, wherein the rotor has an arcuate groove in an outer surface that extends around an angular distance less than 180 degrees, the groove allowing rotation of the rotor to switch positions for "on" "off" and "test," when the rotor is moved axially inward in response to the first force.

4. The rotary switch of claim 3, wherein along the axial depth of the groove is a notch, which when the rotor is in an axial starting position with the switch in the "off" position, contains the stop member on opposite sides to prevent movement in either rotational direction and to latch the switch in the "off" position.

5. The rotary switch of claim 1, wherein the base is provided with a holed lockout tab and wherein the rotor is provided with a holed lockout tab which aligns with a holed lockout tab on the base of the rotary switch to receive a locking member to lock the rotary switch in the "off" position.

6. The rotary switch of claim 1, further comprising a handle for the rotary switch that is mounted on the rotor and has a first grip formed for gripping and rotating the handle in one rotational direction and a second grip formed for gripping and turning the handle in an opposite rotational direction.

7. The rotary switch of claim 6, in which the handle has a central rib and the first grip is formed by a first groove for a thumb along a first side of the rib and grooves for two opposing fingers along an opposite side of central rib for turning the handle in one direction, and wherein the second grip is formed by a groove for a thumb on the opposite side from first groove and grooves for two opposing fingers on the first side of the central rib for turning the handle in an opposite direction.

8. The rotary switch of claim 6, wherein the rotor has a socket opening on an outwardly directed end that opens axially outward, and further comprising a shaft having one end that is received in an outwardly directed socket opening in the rotor, said shaft being coupled to said rotary handle, said shaft having a non-circular cross section to allow torque to be transmitted to the rotor from the handle through the shaft, and said shaft having an extension to another end for coupling to a door handle of an enclosure in which the rotary switch and disconnect switch are situated.

9. The rotary switch of claim 1, wherein the rotor has a spring supporting member extending towards a bottom end and separated from an interior wall of the base by an annular space, and further comprising a compression spring coiled around the spring supporting member and disposed in the space, said spring having a lower end pressing on a rotor in a housing for the disconnect switch and an upper end pressed on by the rotor in the rotary switch, the spring being compressed by axial movement of the switch rotor from a starting position to an operating position and said spring providing a return force for aiding return axial movement of the switch rotor.

10. The rotary switch of claim 1, further comprising a handle for the rotary switch that is coupled to the switch rotor and has a central rib with a first groove for a thumb along a first side and grooves for two opposing fingers along an opposite side of central rib for turning the handle in one direction, said handle also a groove for a thumb on the opposite side from first groove and two opposing fingers on the first sides of the central rib for turning the handle in an opposite direction.

11. A rotary switch assembly for installation inside an electrical enclosure on a disconnect switch to control actuation and de-actuation of the disconnect switch contacts, the rotary switch assembly comprising:

a switching mechanism disposed inside the electrical enclosure for operation in response to movement in opposite rotational directions and in an axial direction to control actuation of the disconnect switch; and a rotary handle for coupling to the switching mechanism, the rotary handle having a first grip formed for gripping and rotating the handle in one rotational direction and a second grip formed for gripping and turning the handle in an opposite rotational direction.

12. The rotary switch assembly of claim 11, wherein the switching mechanism comprises:

a base;

a rotor disposed for rotation in said base and responsive to a first force in an axial direction for coupling to a disconnect switch actuating mechanism, and responsive to a second force in a rotational direction to actuate the disconnect switch; and a stop member on said base for latching the rotor in an "off" position before application of said first force to prevent a rotation of the rotor that would actuate the disconnect switch.

13. The rotary switch assembly of claim 11, wherein the rotary handle has a central rib and the first grip is formed by a first groove for a thumb along a first side of the rib and grooves for two opposing fingers along an opposite side of central rib for turning the handle in one direction, and wherein the second grip is formed by a groove for a thumb on the opposite side from first groove and two opposing fingers on the first side of the central rib for turning the handle in an opposite direction.

14. The rotary switch assembly of claim 13, wherein the handle further comprises thumb and finger rests disposed along a bottom of the thumb and finger grooves and projection laterally therefrom to support the thumb and fingertips and keep them separated from other parts of the switch.

15. The rotary switch assembly of claim 11, wherein the rotary handle has a first grip formed by grooves for a thumb along a first side of the handle and for opposing fingers along an opposite side of the handle for turning the handle in one direction, and wherein the second grip is formed by said grooves for a thumb on the opposite side and for opposing fingers on the first side of the handle for turning the handle in an opposite direction.

16. The rotary switch assembly of claim 12, wherein the base is provided with a holed lockout tab and wherein the rotor is provided with a holed lockout tab which aligns with a holed lockout tab on the base of the rotary switch to receive a locking member to lock the rotary switch in the "off" position.

* * * * *